US008573174B2

(12) United States Patent
Moriya et al.

(10) Patent No.: US 8,573,174 B2
(45) **Date of Patent: *Nov. 5, 2013**

(54) ENGINE STARTING DEVICE AND ENGINE STARTING METHOD

(75) Inventors: Kouki Moriya, Aichi-gun (JP); Jumpei Kakehi, Toyota (JP); Hasrul Sany Bin Hashim, Toyota-shi (MY)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/144,999

(22) PCT Filed: Jul. 16, 2010

(86) PCT No.: PCT/JP2010/062092

§ 371 (c)(1),
(2), (4) Date: Jul. 18, 2011

(87) PCT Pub. No.: WO2012/008050

PCT Pub. Date: Jan. 19, 2012

(65) Prior Publication Data

US 2013/0099507 A1 Apr. 25, 2013

(51) Int. Cl.
*F02N 11/00* (2006.01)

(52) U.S. Cl.
USPC ..... 123/179.3; 123/179.25

(58) Field of Classification Search
USPC ..... 123/179.3, 179.4, 179.25, 179.28, 565, 123/590, 592; 701/110, 111, 113
See application file for complete search history.

(56) References Cited

U.S. PATENT DOCUMENTS

| | | | | |
|---|---|---|---|---|
| 7,093,512 | B2 | 8/2006 | Ibamoto et al. | |
| 8,267,061 | B2 * | 9/2012 | Moriya et al. | 123/179.3 |
| 2008/0162007 | A1 | 7/2008 | Ishii et al. | |
| 2010/0059007 | A1 | 3/2010 | Senda et al. | |
| 2010/0116235 | A1 | 5/2010 | Imamura et al. | |
| 2010/0242905 | A1 | 9/2010 | Machida et al. | |
| 2012/0035837 | A1 | 2/2012 | Okumoto et al. | |

FOREIGN PATENT DOCUMENTS

| | | | |
|---|---|---|---|
| CN | 101666280 | A | 3/2010 |
| EP | 2 159 410 | A2 | 3/2010 |
| JP | A-2001-073911 | | 3/2001 |
| JP | A-2002-115631 | | 4/2002 |
| JP | A-2002-285942 | | 10/2002 |
| JP | A-2005-030348 | | 2/2005 |
| JP | A-2005-330813 | | 12/2005 |
| JP | A-2008-163818 | | 7/2008 |
| JP | A-2009-529114 | | 8/2009 |
| JP | A-2010-031851 | | 2/2010 |
| JP | A-2010-084754 | | 4/2010 |
| WO | WO 2007/101770 | A1 | 9/2007 |

OTHER PUBLICATIONS

Office Action dated Feb. 13, 2012 in U.S. Appl. No. 13/184,997.

(Continued)

*Primary Examiner* — Hai Huynh
(74) *Attorney, Agent, or Firm* — Oliff & Berridge, PLC

(57) ABSTRACT

An ECU executes a program including the steps of carrying out fluctuation suppression control in a case where a request to start an engine has been made, a rotation mode has been selected, and a motor is being driven and canceling fluctuation suppression control in a case where a full drive mode has been selected and engagement between a pinion gear and a ring gear has been completed.

9 Claims, 6 Drawing Sheets

(56) References Cited

OTHER PUBLICATIONS

English language Oct. 5, 2010 International Search Report issued in PCT/JP2010/062089.
U.S. Appl. No. 13/512,990 in the name of Kouki Moriya et al., filed May 31, 2012.
Oct. 5, 2010 International Search Report issued in PCT/JP2010/062092, with translation.
Oct. 5, 2010 International Search Report issued in PCT/JP2010/062204, with translation.
U.S. Appl. No. 13/184,997 in the name of Kouki Moriya et al., filed Jul. 18, 2011.
Office Action issued on Oct. 28, 2011 for U.S. Appl. No. 13/184,997, filed Jul. 18, 2011 to Kouki Moriya.

* cited by examiner

ENGINE STARTING DEVICE AND ENGINE STARTING METHOD

TECHNICAL FIELD

The present invention relates to an engine starting device and an engine starting method and particularly to a starter control technique with which an actuator for moving a pinion gear so as to be engaged with a ring gear provided around an outer circumference of a flywheel or a drive plate of the engine and a motor for rotating the pinion gear are individually controlled.

BACKGROUND ART

In recent years, in order to improve fuel efficiency or reduce exhaust emission, some cars having an internal combustion engine such as an engine include what is called an idling-stop function, in which an engine is automatically stopped while a vehicle stops and a driver operates a brake pedal, and the vehicle is automatically re-started, for example, by a driver's operation for re-start such as decrease in an amount of operation of a brake pedal to zero.

In this idling-stop, the engine may be re-started while an engine speed is relatively high. In such a case, with a conventional starter in which pushing-out of a pinion gear for rotating the engine and rotation of the pinion gear are caused by one drive command, the starter is driven after waiting until the engine speed sufficiently lowers, in order to facilitate engagement between the pinion gear and a ring gear of the engine. Then, a time lag is caused between issuance of a request to re-start an engine and actual engine cranking, and the driver may feel uncomfortable.

In order to solve such a problem, Japanese Patent Laying-Open No. 2005-330813 (Patent Document 1) discloses a technique for causing a pinion gear to perform a rotational operation with the use of a starter configured such that a pinion gear engagement operation and a pinion gear rotational operation can independently be performed prior to the pinion gear engagement operation when a re-start request is issued while rotation of an engine is being lowered immediately after a stop request is generated and for re-starting the engine by causing the pinion gear engagement operation when a pinion gear rotation speed is in synchronization with an engine speed.

CITATION LIST

Patent Document

Patent Document 1: Japanese Patent Laying-Open No. 2005-330813

SUMMARY OF INVENTION

Technical Problem

If the engine speed suddenly fluctuates before a pinion gear engagement operation in an example where the pinion gear engagement operation is performed when the pinion gear rotation speed and the engine speed are in synchronization as in the technique described in Japanese Patent Laying-Open No, 2005-330813, however, it becomes difficult to synchronize the pinion gear rotation speed and the engine speed with each other. Therefore, starting capability of the engine becomes poor.

The present invention was made to solve the above-described problems, and an object of the present invention is to provide an engine starting device and an engine starting method for suppressing deterioration in starting capability of an engine.

Solution to Problem

An engine starting device according to one aspect of the present invention includes a starter for start of an engine, equipment coupled to a crankshaft of the engine and causing load of the engine to fluctuate, and a control device for the starter. The starter includes a second gear that can be engaged with a first gear coupled to the crankshaft of the engine, an actuator for moving the second gear to a position of engagement with the first gear in a driven state, and a motor for rotating the second gear. The control device is capable of individually driving each of the actuator and the motor. The control device has a rotation mode in which the motor is driven prior to drive of the actuator. The control device suppresses fluctuation of the load of the engine and the equipment before the actuator is driven, while the rotation mode is being executed.

Preferably, the control device cancels suppression of fluctuation of the load when engagement between the first gear and the second gear is completed.

Further preferably, the equipment includes at least any one of an air-conditioner compressor and an alternator. The control device holds a state of actuation of the equipment during a period from a first time point after start is requested to a second time point when the actuator is actuated.

Further preferably, the control device holds a state of actuation of the engine during a period from a first time point after start is requested to a second time point when the actuator is actuated.

Further preferably, the control device controls any one of the engine and the equipment so that fluctuation of the load of the engine is prohibited during a period from a first time point after start is requested to a second time point when the actuator is actuated.

Further preferably, the equipment includes at least any one of an air-conditioner compressor and an alternator. The control device prohibits actuation of the equipment during the period from the first time point after the start is requested to the second time point when the actuator is actuated.

Further preferably, the control device prohibits variation in a control value for the engine during the period from the first time point after the start is requested to the second time point when the actuator is actuated.

Further preferably, the control device controls the actuator and the motor such that the engine starts, with any one of a plurality of control modes being selected based on a rotation speed of the engine. The plurality of control modes include a first control mode for actuating the actuator such that the second gear moves toward the first gear after the rotation mode is executed and a second control mode for actuating the motor after actuation of the actuator is started.

In an engine in an engine starting method according to another aspect of the present invention, a starter for starting the engine, equipment coupled to a crankshaft of the engine and causing load of the engine to fluctuate, and a control device for the starter are provided. The starter includes a second gear that can be engaged with a first gear coupled to the crankshaft of the engine, an actuator for moving the second gear to a position of engagement with the first gear in a driven state, and a motor for rotating the second gear. Each of the actuator and the motor can individually be driven. The starting method includes the steps of driving the actuator and the motor in a rotation mode in which the motor is driven prior to drive of the actuator, and suppressing fluctuation of the load of the engine and the equipment before the actuator is driven, while the rotation mode is being executed.

Advantageous Effects of Invention

When a request to start an engine is made, an engine 100 or equipment is controlled such that fluctuation of load of the engine is suppressed before the time point of actuation of an actuator. Thus, sudden fluctuation of an engine speed can be suppressed. Therefore, in a case where the actuator is actuated after a motor is driven, the engine speed can accurately be predicted. Consequently, the timing to start driving the motor for synchronizing the engine speed and a motor speed with each other can accurately be set. Therefore, an engine starting device and an engine starting method for suppressing deterioration in engine starting capability can be provided.

DESCRIPTION OF EMBODIMENTS

Figure 1:
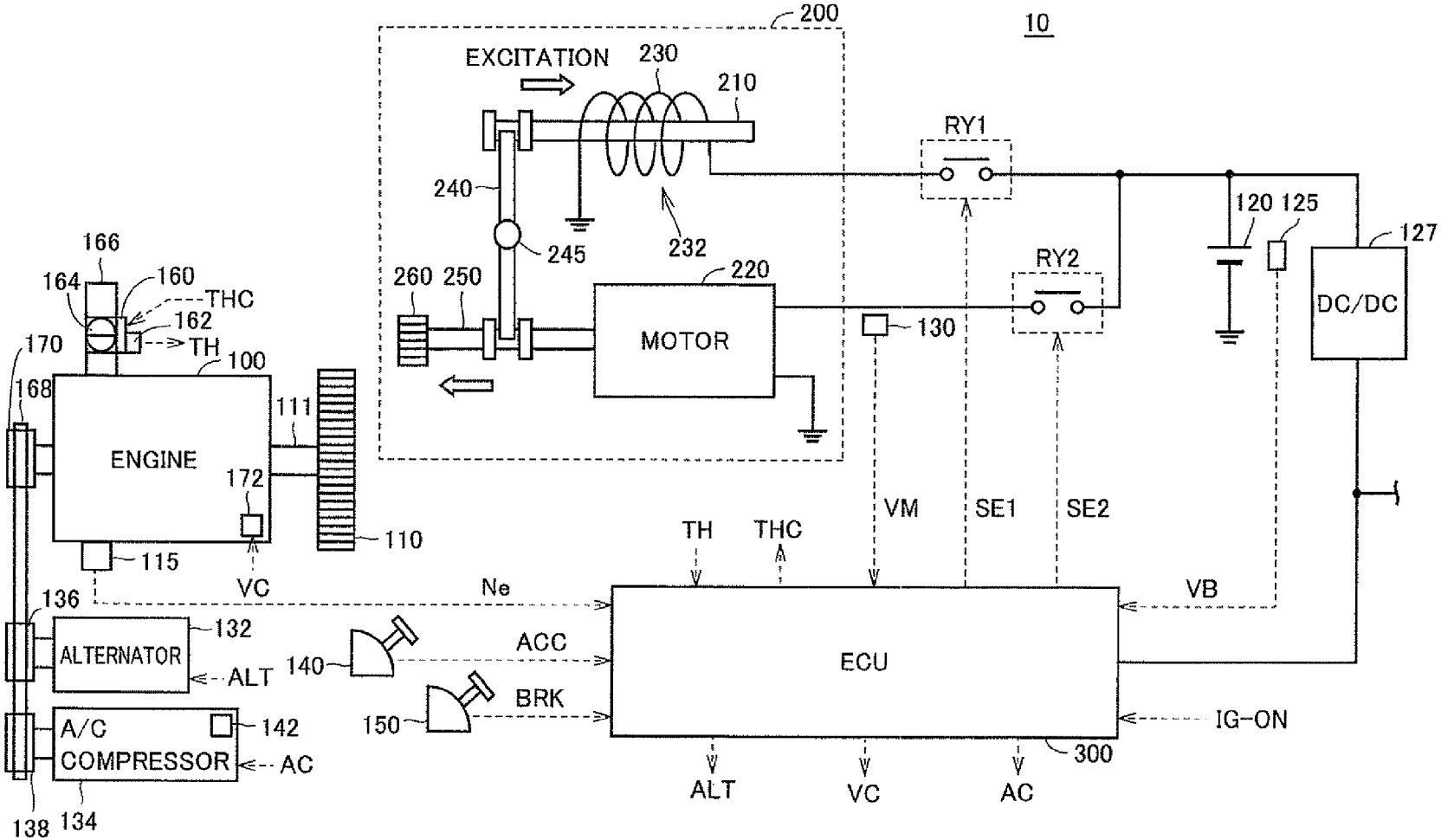
FIG. 1 is an overall block diagram of a vehicle.

An embodiment of the present invention will be described hereinafter with reference to the drawings. In the description below, the same elements have the same reference characters allotted. Their label and function are also identical. Therefore, detailed description thereof will not be repeated.

[Structure of Engine Starting Device]

FIG. 1 is an overall block diagram of a vehicle 10. Referring to FIG. 1, vehicle 10 includes engine 100, a battery 120, a starter 200, a control device (hereinafter also referred to as an ECU (Electronic Control Unit)) 300, and relays RY1, RY2. Starter 200 includes a motor 220, an actuator 232, a coupling portion 240, an output member 250, and a pinion gear 260. Actuator 232 includes a plunger 210 and a solenoid 230.

Engine 100 generates driving force for running vehicle 10. A crankshaft 111 serving as an output shaft of engine 100 is connected to a drive wheel, with a powertrain structured to include a clutch, a reduction gear, or the like being interposed.

Engine 100 is provided with an intake passage 166 for supplying air to engine 100. Intake passage 166 is provided with a throttle valve 164 for regulating a flow rate of air flowing through intake passage 166. Throttle valve 164 is actuated by a throttle motor 160. Throttle motor 160 is driven based on a control signal THC from ECU 300. A position of throttle valve 164, that is, a throttle position, is detected by a throttle position sensor 162. Throttle position sensor 162 outputs a detection value TH to ECU 300.

Engine 100 may be provided with a valve drive actuator 172 for driving an intake valve and an exhaust valve. Valve drive actuator 172 may be an actuator for adjusting each valve opening, for example, by directly driving the intake valve and the exhaust valve, or an actuator for changing timing to close the intake valve and the exhaust valve and a lift amount thereof. Valve drive actuator 172 is driven based on a control signal VC from the ECU.

Engine 100 is provided with a rotation speed sensor 115. Rotation speed sensor 115 detects a speed Ne of engine 100 and outputs a detection result to ECU 300.

Battery 120 is an electric power storage element configured such that it can be charged and can discharge. Battery 120 is configured to include a secondary battery such as a lithium ion battery, a nickel metal hydride battery, a lead-acid battery, or the like. Alternatively, battery 120 may be implemented by a power storage element such as an electric double layer capacitor.

In addition, as equipment causing fluctuation of load of engine 100, an alternator 132 and an air-conditioner compressor 134 are provided in engine 100. A pulley 136 is provided on an input shaft of alternator 132. In addition, a pulley 138 is provided on an input shaft of air-conditioner compressor 134. A pulley 168 is provided on crankshaft 111 of engine 100. Pulleys 136, 138 and 168 are coupled to one another by a belt 170. Therefore, torque of crankshaft 111 of engine 100 is transmitted to pulley 168 and to pulleys 136 and 138 through belt 170.

Alternator 132 generates electric power by using torque transmitted to pulley 136, by exciting a contained electromagnetic coil, based on a control signal ALT from ECU 300. Alternator 132 charges battery 120 by supplying generated electric power to battery 120 through an inverter, a converter or the like that is not shown. It is noted that alternator 132 may charge battery 120 by supplying electric power generated by alternator 132 to battery 120 through a not-shown inverter and a DC/DC converter 127. An amount of electric power generation by alternator 132 is controlled by ECU 300.

Air-conditioner compressor 134 is actuated based on a control signal AC from ECU 300. Air-conditioner compressor 134 contains an electromagnetic clutch 142. Electromagnetic clutch 142 is in an engaged state or in a disengaged state, based on control signal AC from ECU 300.

When electromagnetic clutch 142 is in the engaged state, torque transmitted from crankshaft 111 to pulley 138 through belt 170 is transmitted to the input shaft of air-conditioner compressor 134. Therefore, as pulley 138 and the input shaft of air-conditioner compressor 134 integrally rotate, air-conditioner compressor 134 is actuated.

Alternatively, when electromagnetic clutch 142 is in the disengaged state, torque transmitted from crankshaft 111 to pulley 138 through belt 170 is not transmitted to the input shaft of air-conditioner compressor 134. Therefore, in this case, only pulley 138 out of pulley 138 and the input shaft of air-conditioner compressor 134 rotates.

The starting device for engine 100 according to the present embodiment includes starter 200 for starting engine 100, equipment coupled to crankshaft 111 of the engine and causing load of engine 100 to fluctuate (alternator 132, air-conditioner compressor 134), and ECU 300 representing the control device for starter 200.

Battery 120 is connected to starter 200 with relays RY1, RY2 controlled by ECU 300 being interposed. Battery 120 supplies a supply voltage for driving to starter 200 as relays RY1, RY2 are closed. It is noted that a negative electrode of battery 120 is connected to a body earth of vehicle 10.

Battery 120 is provided with a voltage sensor 125. Voltage sensor 125 detects an output voltage VB of battery 120 and outputs a detection value to ECU 300.

The voltage of battery 120 is supplied to ECU 300 and auxiliary machinery such as an inverter of an air-conditioning apparatus through DC/DC converter 127. DC/DC converter 127 is controlled by ECU 300 so as to maintain a voltage supplied to ECU 300 and the like. For example, in view of the fact that the voltage of battery 120 temporarily lowers as a result of drive of motor 220 for cranking engine 100, DC/DC converter 127 is controlled so as to raise the voltage when motor 220 is driven.

As will be described later, since motor 220 is controlled to be driven while a signal requesting start of engine 100 is output, DC/DC converter 127 is controlled to raise a voltage while the signal requesting start of engine 100 is output. A method of controlling DC/DC converter 127 is not limited thereto.

Relay RY1 has one end connected to a positive electrode of battery 120 and the other end connected to one end of solenoid 230 within starter 200. Relay RY1 is controlled by a control signal SE1 from ECU 300 so as to switch between supply and cut-off of a supply voltage from battery 120 to solenoid 230.

Relay RY2 has one end connected to the positive electrode of battery 120 and the other end connected to motor 220 within starter 200. Relay RY2 is controlled by a control signal SE2 from ECU 300 so as to switch between supply and cut-off of a supply voltage from battery 120 to motor 220. In addition, a voltage sensor 130 is provided in a power line connecting relay RY2 and motor 220 to each other. Voltage sensor 130 detects a motor voltage VM and outputs a detection value to ECU 300.

In the present embodiment, starter 200 includes a second gear that can be engaged with a first gear coupled to crankshaft 111 of engine 100, actuator 232 for moving the second gear to a position of engagement with the first gear in a driven state, and motor 220 for rotating the second gear. The "first gear" in the present embodiment is a ring gear 110 coupled to crankshaft 111 of engine 100, and the "second gear" is pinion gear 260.

As described above, supply of a supply voltage to motor 220 and solenoid 230 within starter 200 can independently be controlled by relays RY1, RY2.

Output member 250 is coupled to a rotation shaft of a rotor (not shown) within the motor, for example, by a straight spline or the like. In addition, pinion gear 260 is provided on an end portion of output member 250 opposite to motor 220. As relay RY2 is closed, the supply voltage is supplied from battery 120 so as to rotate motor 220. Then, output member 250 transmits the rotational operation of the rotor to pinion gear 260, to thereby rotate pinion gear 260.

As described above, solenoid 230 has one end connected to relay RY1 and the other end connected to the body earth. As relay RY1 is closed and solenoid 230 is excited, solenoid 230 attracts plunger 210 in a direction of arrow.

Plunger 210 is coupled to output member 250 with coupling portion 240 being interposed. As solenoid 230 is excited, plunger 210 is attracted in the direction of the arrow. Thus, coupling portion 240 of which fulcrum 245 is fixed moves output member 250 from a stand-by position shown in FIG. 1 in a direction reverse to a direction of operation of plunger 210, that is, a direction in which pinion gear 260 moves away from a main body of motor 220. In addition, biasing force reverse to the arrow in FIG. 1 is applied to plunger 210 by a not-shown spring mechanism, and when solenoid 230 is no longer excited, it returns to the stand-by position.

As output member 250 thus operates in an axial direction as a result of excitation of solenoid 230, pinion gear 260 is engaged with ring gear 110 provided around an outer circumference of a flywheel or a drive plate attached to crankshaft 111 of engine 100. Then, as pinion gear 260 performs a rotational operation while pinion gear 260 and ring gear 110 are engaged with each other, engine 100 is cranked and started.

Thus, in the present embodiment, actuator 232 for moving pinion gear 260 so as to be engaged with ring gear 110 provided around the outer circumference of the flywheel or the drive plate of engine 100 and motor 220 for rotating pinion gear 260 are individually controlled.

Though not shown in FIG. 1, a one-way clutch may be provided between output member 250 and the rotor shaft of motor 220 such that the rotor of motor 220 does not rotate due to the rotational operation of ring gear 110.

In addition, actuator 232 in FIG. 1 is not limited to the mechanism as above so long as it is a mechanism capable of transmitting rotation of pinion gear 260 to ring gear 110 and switching between a state that pinion gear 260 and ring gear 110 are engaged with each other and a state that they are not engaged with each other. For example, such a mechanism that pinion gear 260 and ring gear 110 are engaged with each other as a result of movement of the shaft of output member 250 in a radial direction of pinion gear 260 is also applicable.

ECU 300 includes a CPU (Central Processing Unit), a storage device, and an input/output buffer, none of which is shown, and receives input from each sensor or provides output of a control command to each piece of equipment. It is noted that control of these components is not limited to processing by software, and a part thereof may also be constructed by dedicated hardware (electronic circuitry) and processed.

ECU 300 receives a signal ACC indicating an amount of operation of an accelerator pedal 140 from a sensor (not shown) provided on accelerator pedal 140. ECU 300 receives a signal BRK indicating an amount of operation of a brake pedal 150 from a sensor (not shown) provided on brake pedal 150. In addition, ECU 300 receives a start operation signal IG-ON issued in response to a driver's ignition operation or the like. Based on such information, ECU 300 generates a signal requesting start of engine 100 and a signal requesting stop thereof and outputs control signal SE1, SE2 in accordance therewith, so as to control an operation of starter 200.

ECU 300 can individually cause drive of each of actuator 232 and motor 220. In addition, ECU 300 has a rotation mode in which motor 220 is driven prior to drive of actuator 232. In the present embodiment, ECU 300 suppresses fluctuation of the load of engine 100 and the above-described equipment (that is, alternator 132 and air-conditioner compressor 134) before actuator 232 is driven, while the rotation mode is being executed.

Figure 2:
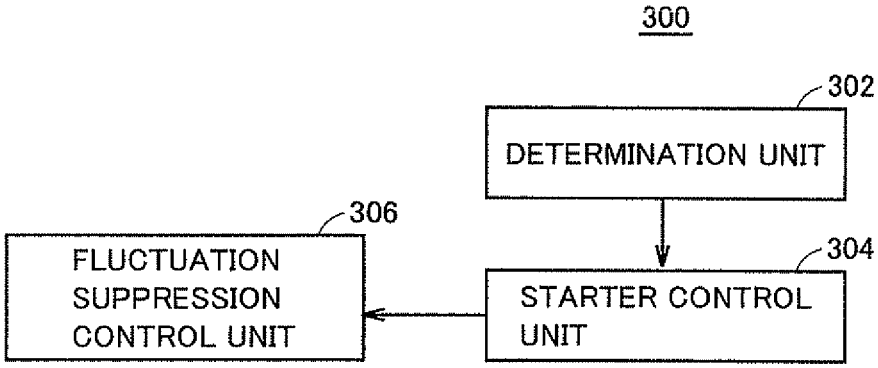
FIG. 2 is a functional block diagram of an ECU.

Referring to FIG. 2, a function of ECU 300 will be described. It is noted that a function of ECU 300 described below may be implemented by software or hardware or by cooperation of software and hardware.

ECU 300 includes a determination unit 302, a starter control unit 304, and a fluctuation suppression control unit 306. Determination unit 302 determines whether start of engine 100 has been requested or not. For example, when an amount of operation of brake pedal 150 by the driver decreases to zero, determination unit 302 determines that start of engine 100 has been requested. More specifically, when the amount of operation of brake pedal 150 by the driver decreases to zero while engine 100 and vehicle 10 remain stopped, determination unit 302 determines that start of engine 100 has been requested. A method of determination as to whether or not start of engine 100 has been requested that is made by determination unit 302 is not limited thereto. When ECU 300 determines that start of engine 100 has been requested, ECU 300 generates a signal requesting start of engine 100 and outputs control signal SE1, SE2 in accordance therewith.

In the present embodiment, when a signal requesting start of engine 100 is generated, that is, when it is determined that start of engine 100 has been requested, starter control unit 304 controls actuator 232 and motor 220 so as to start engine 100, by selecting any one of a plurality of control modes based on speed Ne of engine 100. The plurality of control modes include a first mode in which actuator 232 and motor 220 are controlled such that pinion gear 260 starts rotation after pinion gear 260 moves toward ring gear 110 and a second mode in which actuator 232 and motor 220 are controlled such that pinion gear 260 moves toward ring gear 110 after pinion gear 260 starts rotation.

It is noted that, when it is determined that start of engine 100 has been requested, starter control unit 304 may control actuator 232 and motor 220 such that pinion gear 260 moves toward ring gear 110 after pinion gear 260 starts rotation, without selecting any one of the plurality of control modes.

When starter control unit 304 selected the first mode, starter control unit 304 controls actuator 232 such that pinion gear 260 moves toward ring gear 110 when determination unit 302 determined that start of engine 100 has been requested and starter control unit 304 controls motor 220 such that pinion gear 260 rotates after pinion gear 260 moved toward ring gear 110.

When starter control unit 304 selected the second mode, starter control unit 304 controls motor 220 such that pinion gear 260 starts rotation when determination unit 302 determined that start of engine 100 has been requested and starter control unit 304 controls actuator 232 such that pinion gear 260 moves toward ring gear 110 after pinion gear 260 started rotation.

When speed Ne of engine 100 is equal to or smaller than a first predetermined reference value $\alpha 1$, starter control unit 304 selects the first mode. When speed Ne of engine 100 is greater than first reference value $\alpha 1$, starter control unit 304 selects the second mode.

In a case where the second mode is selected, fluctuation suppression control unit 306 controls at least any one of engine 100 and the equipment coupled to engine 100 and causing the load of engine 100 to fluctuate as it is actuated, such that fluctuation of the load of engine 100 is suppressed before the time point when starter control unit 304 actuates actuator 232.

Specifically, when starter control unit 304 selects the second mode and determination unit 302 determines that the request to start engine 100 has been made, fluctuation suppression control unit 306 controls engine 100 or the equipment causing the load of engine 100 to fluctuate as it is actuated, such that fluctuation of the load of engine 100 is suppressed during a period from a first time point after start is requested to a second time point when starter control unit 304 actuates actuator 232. The first time point may be a time point when it is determined that start has been requested or a time point when actuation of motor 220 is started, and it is a time point set such that speed Ne of engine 100 does not suddenly fluctuate at least before actuator 232 is actuated.

Description is given in the present embodiment, assuming that the equipment causing the load of engine 100 to fluctuate is any one of alternator 132 and air-conditioner compressor 134. The equipment, however, is not particularly limited thereto, so long as it is equipment coupled to belt 170 in addition to alternator 132 and air-conditioner compressor 134. For example, a pump for generating a hydraulic pressure in a power steering actuated with motive power from engine 100 in response to a control signal from ECU 300 may be adopted as the equipment.

In a case where the second mode has been selected, fluctuation suppression control unit 306 suppresses fluctuation of the load of engine 100 by holding a state of actuation of the equipment during a period from the first time point after start was requested to the second time point when actuator 232 is actuated.

For example, in a case where the second mode has been selected and alternator 132 is actuated at the first time point after start was requested, fluctuation suppression control unit 306 controls alternator 132 such that an amount of electric power generation by alternator 132 is held during a period from the first time point to the second time point.

For example, in a case where the second mode has been selected, a state of electromagnetic clutch 142 is in the engaged state at the first time point after start was requested, and air-conditioner compressor 134 is actuated, fluctuation suppression control unit 306 controls air-conditioner compressor 134 such that the engaged state of electromagnetic clutch 142 and an amount of actuation of air-conditioner compressor 134 are held during a period from the first time point to the second time point.

In addition, for example, in a case where the second mode has been selected and both of alternator 132 and air-conditioner compressor 134 are actuated at the first time point after start was requested, fluctuation suppression control unit 306 controls alternator 132 and air-conditioner compressor 134 such that an amount of actuation of alternator 132, a state of engagement of electromagnetic clutch 142, and an amount of actuation of air-conditioner compressor 134 are held during a period from the first time point to the second time point.

Moreover, in a case where the second mode has been selected, fluctuation suppression control unit 306 holds a state of actuation of engine 100 during a period from the first time point after start was requested to the second time point when actuator 232 is actuated. For example, fluctuation suppression control unit 306 may control throttle motor 160 so as to hold a position of the throttle valve or may control valve drive actuator 172 so as to hold each amount of opening of the intake valve and the exhaust valve or each of a lift amount thereof and the timing to close them.

Alternatively, in a case where the second mode has been selected, fluctuation suppression control unit 306 may control any one of engine 100 and the equipment such that fluctuation of the load of engine 100 is prohibited during a period from the first time point after start was requested to the second time point when actuator 232 is actuated.

For example, in a case where the second mode has been selected, fluctuation suppression control unit 306 prohibits actuation of the equipment during a period from the first time point after start was requested to the second time point when actuator 232 is actuated. For example, when an operation for actuating an air-conditioning apparatus is performed or a request for actuating the air-conditioning apparatus in order to automatically adjust a temperature in a room is made as well, fluctuation suppression control unit 306 prohibits electromagnetic clutch 142 from entering an engaged state.

Alternatively, for example, when a request to actuate alternator 132 is made, fluctuation suppression control unit 306 prohibits actuation of alternator 132.

Further, in a case where the second mode has been selected, fluctuation suppression control unit 306 prohibits variation in a control value for engine 100 during a period from the first time point after start was requested to the second time point when actuator 232 is actuated. The control value for engine 100 refers, for example, to a control value for a throttle position, a control value for each amount of opening of the intake valve and the exhaust valve, or a control value for each of a lift amount of the intake valve and the exhaust valve and the timing to close them. In a case where the second mode has been selected, fluctuation suppression control unit 306 prohibits, for example, throttle valve 164 from being fully closed or the intake valve and the exhaust valve from being fully closed during a period from the first time point after start was requested to the second time point when actuator 232 is actuated.

When engagement between ring gear 110 and pinion gear 260 is completed, fluctuation suppression control unit 306 cancels suppression or prohibition of fluctuation of the load. For example, when a value of a current to solenoid 230 attains to a value indicating that solenoid 230 is driven, fluctuation suppression control unit 306 may determine that engagement between ring gear 110 and pinion gear 260 has been completed. Alternatively, for example, when such a state that an absolute value of difference between a speed Nm of motor 220 and speed Ne of engine 100 is equal to or lower than a predetermined value continues from actuation of motor 220 and actuator 232 until lapse of a predetermined period of time, fluctuation suppression control unit 306 may determine that engagement between ring gear 110 and pinion gear 260 has been completed.

[Description of Operation Mode of Starter]

Figure 3:
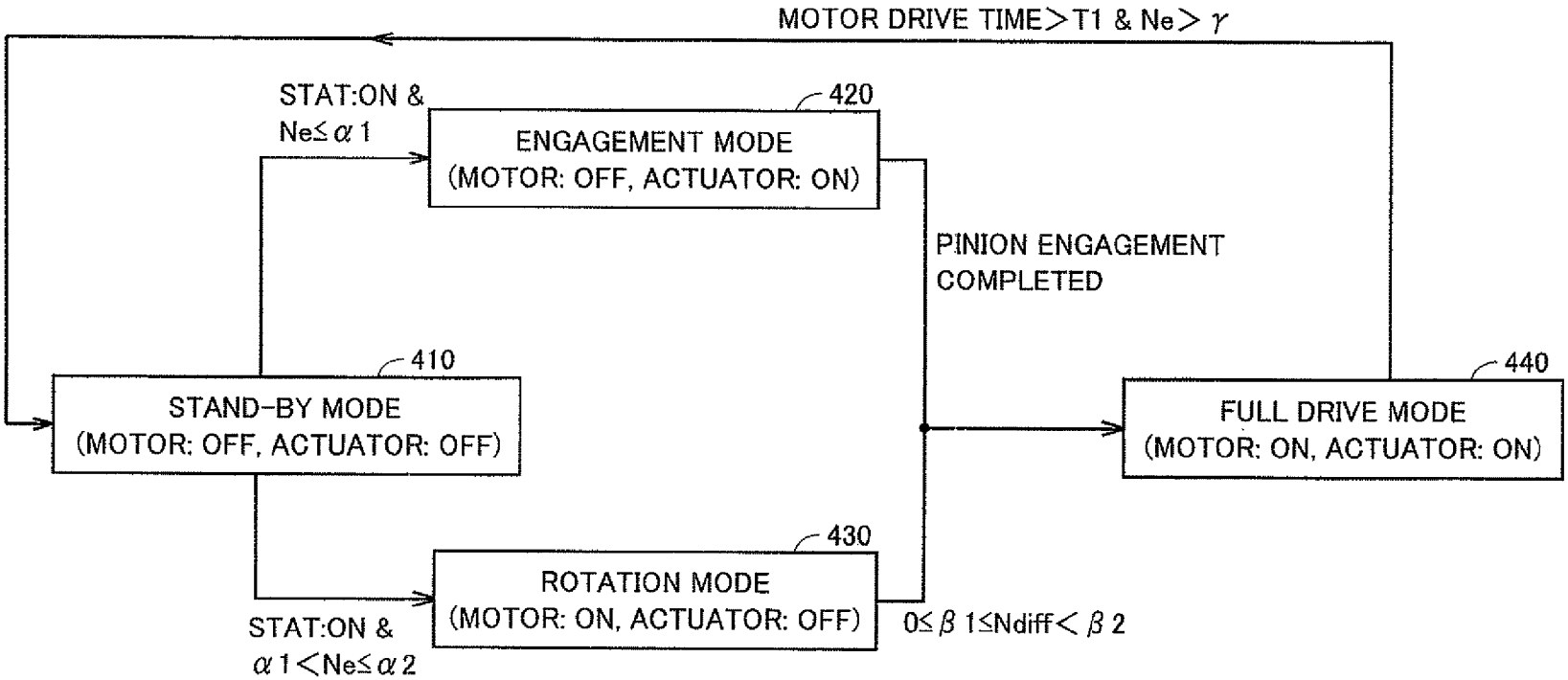
FIG. 3 is a diagram for illustrating transition of an operation mode of a starter.

FIG. 3 is a diagram for illustrating transition of an operation mode of starter 200 in the present embodiment. The operation mode of starter 200 in the present embodiment includes a stand-by mode 410, an engagement mode 420, a rotation mode 430, and a full drive mode 440.

The first mode described previously is a mode in which transition to full drive mode 440 is made via engagement mode 420. The second mode described previously is a mode in which transition to full drive mode 440 is made via rotation mode 430.

Stand-by mode 410 is a mode in which drive of both of actuator 232 and motor 220 in starter 200 is stopped, and it is a mode selected when start of engine 100 is not requested. Stand-by mode 410 corresponds to the initial state of starter 200, and it is selected when drive of starter 200 is not necessary, for example, before an operation to start engine 100, after completion of start of engine 100, failure in starting engine 100, and the like.

Full drive mode 440 is a mode in which both of actuator 232 and motor 220 in starter 200 are driven. When this full drive mode 440 is selected, motor 220 and actuator 232 are controlled such that pinion gear 260 rotates while pinion gear 260 and ring gear 110 are engaged with each other. Thus, engine 100 is actually cranked and the operation for start is started.

As described above, starter 200 in the present embodiment can independently drive each of actuator 232 and motor 220. Therefore, in a process of transition from stand-by mode 410 to full drive mode 440, there are a case where actuator 232 is driven prior to drive of motor 220 (that is, corresponding to engagement mode 420) and a case where motor 220 is driven prior to drive of actuator 232 (that is, corresponding to rotation mode 430).

Selection between these engagement mode 420 and rotation mode 430 is basically made based on speed Ne of engine 100 when re-start of engine 100 is requested.

Engagement mode 420 refers to a state where only actuator 232 out of actuator 232 and motor 220 is driven and motor 220 is not driven. This mode is selected when pinion gear 260 and ring gear 110 can be engaged with each other even while pinion gear 260 remains stopped. Specifically, while engine 100 remains stopped or while speed Ne of engine 100 is sufficiently low (Ne≤first reference value $\alpha 1$), this engagement mode 420 is selected.

After a signal requesting start of engine 100 is generated, engagement mode 420 is selected for actuator 232 and motor 220.

Then, after engagement mode 420 is selected as the operation mode, the operation mode makes transition from engagement mode 420 to full drive mode 440. Namely, full drive mode 440 is selected and actuator 232 and motor 220 are controlled. Namely, in the present embodiment, based on lapse of a predetermined period of time since start of drive of actuator 232, it is determined that engagement of pinion gear 260 and ring gear 110 with each other has been completed.

Meanwhile, rotation mode 430 refers to a state where only motor 220 out of actuator 232 and motor 220 is driven and actuator 232 is not driven. This mode is selected, for example, when a request for re-start of engine 100 is output immediately after stop of engine 100 is requested and when speed Ne of engine 100 is relatively high ($\alpha 1$<Ne≤second reference value $\alpha 2$).

When a signal requesting start of engine 100 is generated, actuator 232 and motor 220 are controlled in rotation mode 430.

Thus, when speed Ne of engine 100 is high, difference in speed between pinion gear 260 and ring gear 110 is great while pinion gear 260 remains stopped, and engagement between pinion gear 260 and ring gear 110 may become difficult. Therefore, in rotation mode 430, only motor 220 is driven prior to drive of actuator 232, so that speed Ne of ring gear 110 and a speed of pinion gear 260 are in synchronization with each other. Then, when it is determined that synchronization has been established in response to difference between speed Ne of ring gear 110 and the speed of pinion gear 260 being sufficiently small, actuator 232 is driven and ring gear 110 and pinion gear 260 are engaged with each other. Then, the operation mode makes transition from rotation mode 430 to full drive mode 440.

In the present embodiment, determination of establishment of synchronization is specifically made based on whether or not a relative speed Ndiff between speed Ne of engine 100 and a speed of pinion gear 260 (speed Nm of motor 220 converted to a crankshaft speed) (=Ne−Nm) is in between prescribed threshold values ($0 \le \beta 1 \le$ Ndiff$<\beta 2$). Though determination of establishment of synchronization may be made based on whether or not an absolute value of relative speed Ndiff is smaller than a threshold value $\beta$ ($|$Ndiff$|<\beta$), engagement is more preferably carried out while speed Ne of engine 100 is higher than the speed of pinion gear 260.

In the case of full drive mode 440, the operation mode returns from full drive mode 440 to stand-by mode 410 in response to completion of start of engine 100 and start of a self-sustained operation of engine 100.

Thus, when a signal requesting start of engine 100 is output, that is, when it is determined that engine 100 is to be started, actuator 232 and motor 220 are controlled in any one mode of the first mode in which transition to full drive mode 440 is made via engagement mode 420 and the second mode in which transition to full drive mode 440 is made via rotation mode 430.

Figure 4:
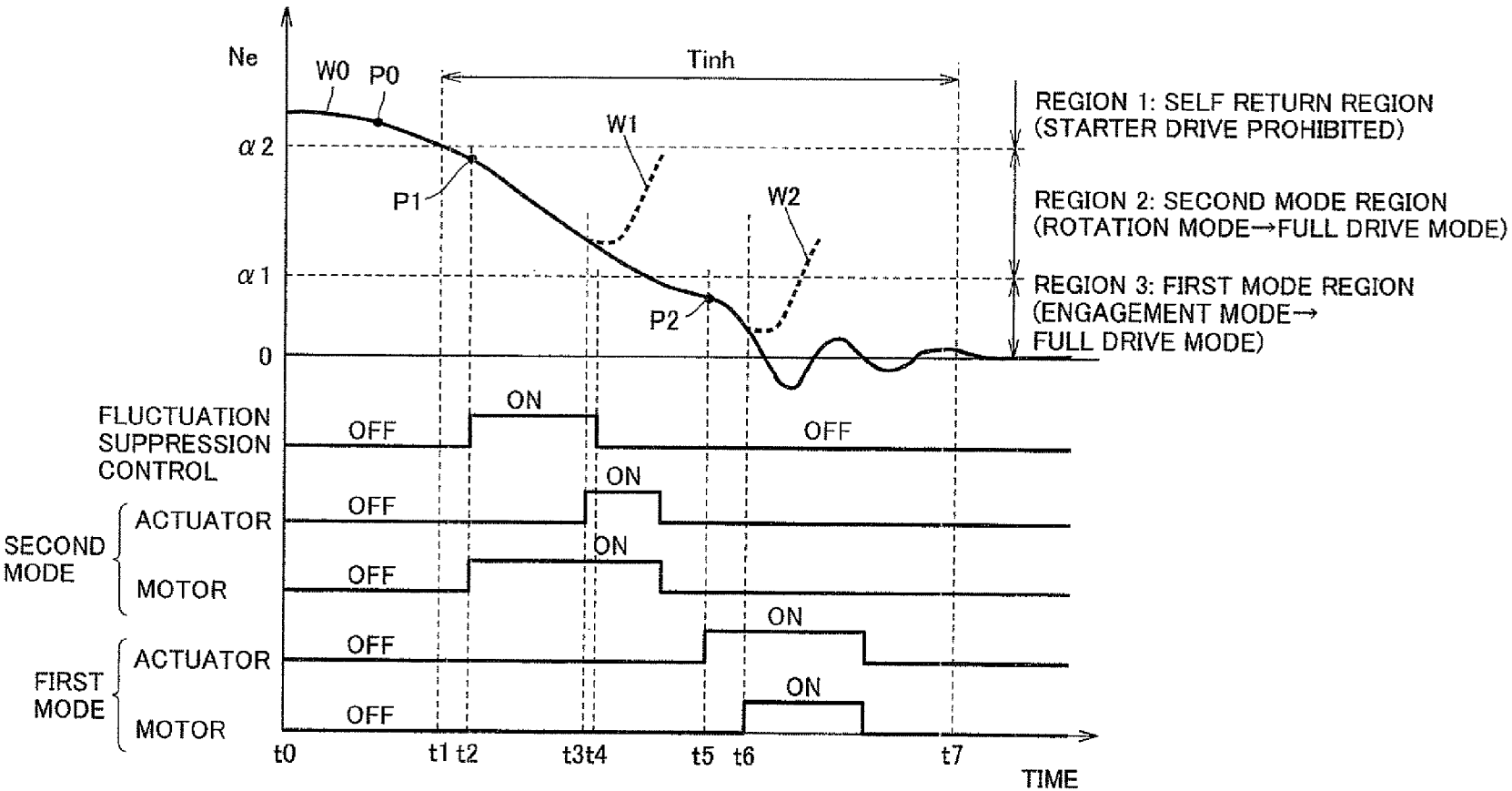
FIG. 4 is a diagram for illustrating a drive mode in an engine start operation.

FIG. 4 is a diagram for illustrating engine start control in two drive modes (the first mode, the second mode) selected in an engine start operation and fluctuation suppression control carried out in parallel to engine start control in the present embodiment.

In FIG. 4, the abscissa indicates time and the ordinate indicates speed Ne of engine 100 and a state of drive of actuator 232 and motor 220 in the first mode and the second mode.

A case where, at a time t0, for example, a condition that vehicle 10 stops and the driver operates brake pedal 150 is satisfied and consequently a request to stop engine 100 is generated and combustion in engine 100 is stopped is assumed. Here, unless engine 100 is re-started, speed Ne of engine 100 gradually lowers as shown with a solid curve W0 and finally rotation of engine 100 stops.

Then, a case where, for example, an amount of the driver's operation of brake pedal 150 attains to zero while speed Ne of engine 100 is lowering, and thus a request to re-start engine 100 is generated is considered. Here, categorization into three regions based on speed Ne of engine 100 is made.

A first region (region 1) refers to a case where speed Ne of engine 100 is higher than second reference value α2, and for example, such a state that a request for re-start is generated at a point P0 in FIG. 4.

This region 1 is a region where engine 100 can be started by a fuel injection and ignition operation without using starter 200 because speed Ne of engine 100 is sufficiently high. Namely, region 1 is a region where engine 100 can return by itself. Therefore, in region 1, drive of starter 200 is prohibited. It is noted that second reference value α2 described above may be restricted depending on a maximum speed of motor 220.

A second region (region 2) refers to a case where speed Ne of engine 100 is located between first reference value α1 and second reference value α2, and such a state that a request for re-start is generated at a point P1 in FIG. 4.

This region 2 is a region where speed Ne of engine 100 is relatively high, although engine 100 cannot return by itself. In this region, the rotation mode (the second mode) is selected as described with reference to FIG. 3.

When a request to re-start engine 100 is generated at a time t2, starter control unit 304 initially drives motor 220. Thus, pinion gear 260 starts to rotate. In addition, fluctuation suppression control unit 306 carries out fluctuation suppression control as motor 220 is driven. Since fluctuation suppression control has been described above, detailed description thereof will not be repeated. As a result of fluctuation suppression control, sudden fluctuation of speed Ne of engine 100 is suppressed.

At a time t3, actuator 232 is driven. When actuator 232 is driven so that engagement between ring gear 110 and pinion gear 260 is completed, fluctuation suppression control is canceled at time t4. Then, when ring gear 110 and pinion gear 260 are engaged with each other, engine 100 is cranked and speed Ne of engine 100 increases as shown with a dashed curve W1. Thereafter, when engine 100 resumes the self-sustained operation, drive of actuator 232 and motor 220 is stopped.

A third region (region 3) refers to a case where speed Ne of engine 100 is lower than first reference value α1, and for example, such a state that a request for re-start is generated at a point P2 in FIG. 4.

This region 3 is a region where speed Ne of engine 100 is low and pinion gear 260 and ring gear 110 can be engaged with each other without synchronizing pinion gear 260. In this region, the engagement mode is selected as described with reference to FIG. 3.

When a request to re-start engine 100 is generated at a time t5, starter control unit 304 initially drives actuator 232. Thus, pinion gear 260 is pushed toward ring gear 110. At a time t6, when engagement between ring gear 110 and pinion gear 260 is completed after drive of actuator 232, motor 220 is driven. Thus, engine 100 is cranked and speed Ne of engine 100 increases as shown with a dashed curve W2. Thereafter, when engine 100 resumes the self-sustained operation, drive of actuator 232 and motor 220 is stopped.

By thus controlling re-start of engine 100 by using starter 200 in which actuator 232 and motor 220 can independently be driven, engine 100 can be re-started in a shorter period of time than in a case of a conventional starter where an operation to re-start engine 100 was prohibited during a period (Tinh) from a speed at which return of engine 100 by itself was impossible (time t1 in FIG. 4) to stop of engine 100 (a time t7 in FIG. 4). Thus, the driver's uncomfortable feeling due to delayed re-start of the engine can be lessened.

[Description of Operation Mode Setting Control]

Figure 5:
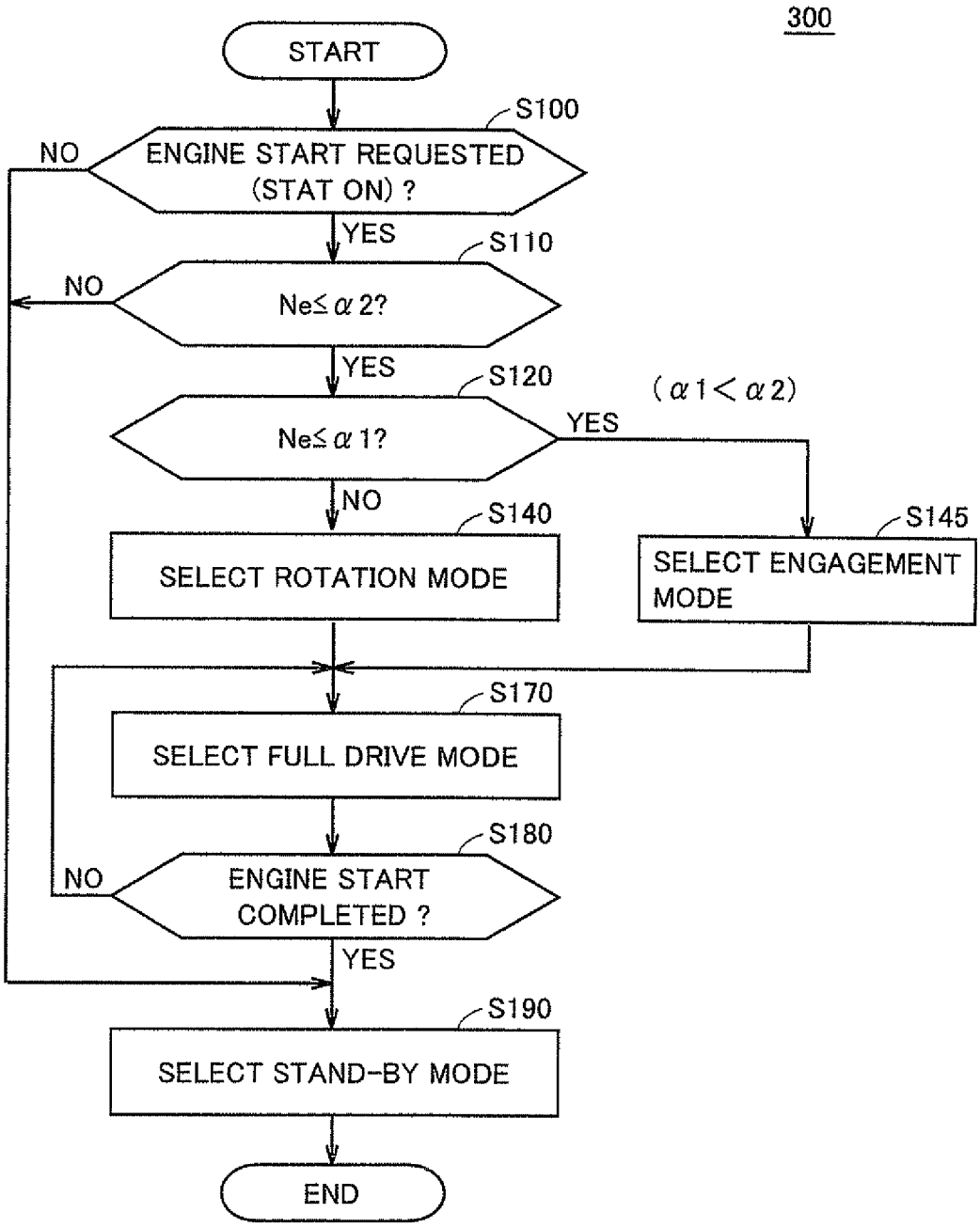
FIG. 5 is a flowchart (No. 1) showing a control structure of processing performed by the ECU.

FIG. 5 is a flowchart for illustrating details of operation mode setting control processing performed by starter control unit 304 of ECU 300 in the present embodiment. The flowchart shown in FIG. 5 is realized by executing a program stored in advance in a memory of ECU 300 in a prescribed cycle. Alternatively, regarding some steps, processing can also be performed by constructing dedicated hardware (electronic circuitry).

Referring to FIGS. 1 and 5, in step (hereinafter the step being abbreviated as S) 100, starter control unit 304 determines whether start of engine 100 has been requested or not.

When start of engine 100 has not been requested (NO in S100), starter control unit 304 causes the process to proceed to S190 and selects the stand-by mode because an operation to start engine 100 is not necessary.

When start of engine 100 has been requested (YES in S100), the process proceeds to S110 and starter control unit 304 then determines whether or not speed Ne of engine 100 is equal to or smaller than second reference value α1.

When speed Ne of engine 100 is greater than second reference value α2 (NO in S110), this case corresponds to region 1 in FIG. 4 where engine 100 can return by itself. Therefore, starter control unit 304 causes the process to proceed to S190 and selects the stand-by mode.

When speed Ne of engine 100 is equal to or smaller than second reference value a2 (YES in S110), starter control unit 304 further determines whether or not speed Ne of engine 100 is equal to or smaller than first reference value α1.

When speed Ne of engine 100 is equal to or smaller than first reference value α1 (YES in S120), this case corresponds to region 1 in FIG. 4. Therefore, the process proceeds to S145 and starter control unit 304 selects the engagement mode. Then, starter control unit 304 outputs control signal SE1 so as to close relay RY1, and thus actuator 232 is driven. Here, motor 220 is not driven.

Thereafter, the process proceeds to S170 and starter control unit 304 selects the full drive mode. Then, starter 200 starts cranking of engine 100.

Then, in S180, starter control unit 304 determines whether start of engine 100 has been completed or not. Determination of completion of start of engine 100 may be made, for example, based on whether or not the engine speed is greater than a threshold value γ indicating the self-sustained operation after lapse of a prescribed period of time since start of drive of motor 220.

When start of engine 100 has not been completed (NO in S180), the process returns to S170 and cranking of engine 100 is continued.

When start of engine 100 has been completed (YES in S180), the process proceeds to S190 and ECU 300 selects the stand-by mode.

On the other hand, when speed Ne of engine 100 is greater than first reference value α1 (NO in S120), the process proceeds to S140 and ECU 300 selects the rotation mode. Then, ECU 300 outputs control signal SE2 so as to close relay RY2, and thus motor 220 is driven. Here, actuator 232 is not driven.

Then, ECU 300 selects the full drive mode in S170. Thus, actuator 232 is driven, pinion gear 260 and ring gear 110 are engaged with each other, and engine 100 is cranked.

[Description of Fluctuation Suppression Control]

Figure 6:
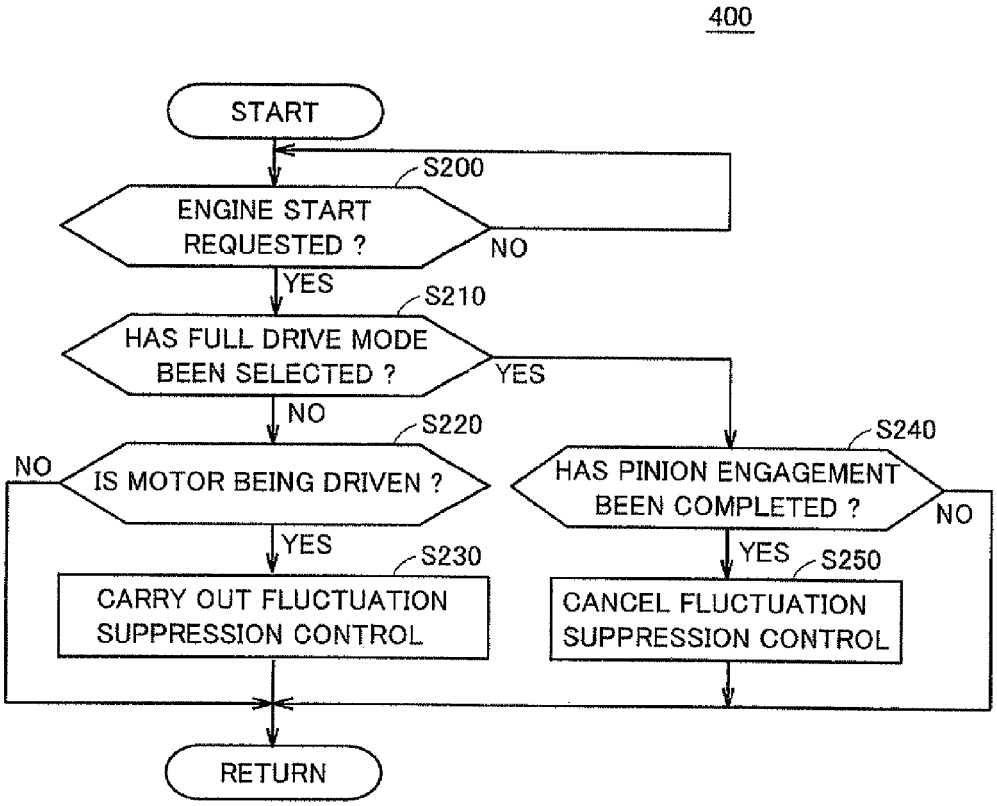
FIG. 6 is a flowchart (No. 2) showing a control structure of processing performed by the ECU.

FIG. 6 is a flowchart for illustrating details of processing in fluctuation suppression control carried out by fluctuation suppression control unit 306 of ECU 300 in the present embodiment. The flowchart shown in FIG. 6 is realized by executing a program stored in advance in a memory of ECU 300 in a prescribed cycle. Alternatively, regarding some steps, processing can also be performed by constructing dedicated hardware (electronic circuitry).

Referring to FIGS. 1 and 6, in S200, fluctuation suppression control unit 306 determines whether a request to start engine 100 has been made or not.

When a request to start engine 100 has not been made (NO in S200), the process returns to S200. When a request to start engine 100 has been made (YES in S200), the process proceeds to S210 and fluctuation suppression control unit 306 determines whether the full drive mode has been selected or not.

For example, when both of motor 220 and actuator 232 are actuated, fluctuation suppression control unit 306 determines that the full drive mode has been selected. Alternatively, for example, when motor 220 is actuated while actuation of actuator 232 is stopped or when both of motor 220 and actuator 232 have stopped actuation, fluctuation suppression control unit 306 determines that the full drive mode has not been selected.

When it is determined that the full drive mode has not been selected (NO in S210), the process proceeds to S220, in which whether motor 220 is being driven or not is determined.

When motor 220 is being driven (YES in S220), fluctuation suppression control unit 306 carries out fluctuation suppression control. Namely, fluctuation suppression control unit 306 suppresses fluctuation of the load of engine 100 by holding a state of actuation of at least any one of engine 100, and alternator 132 and air-conditioner compressor 134.

When motor 220 is not being driven (NO in S220), fluctuation suppression control unit 306 ends this process.

Alternatively, when it is determined that the full drive mode has been selected (YES in S210), the process proceeds to S240, in which fluctuation suppression control unit 306 determines whether engagement between pinion gear 260 and ring gear 110 has been completed or not.

When it is determined that engagement between pinion gear 260 and ring gear 110 has been completed (YES in S240), the process proceeds to S250, in which fluctuation suppression control unit 306 cancels fluctuation suppression control. When it is determined that engagement between pinion gear 260 and ring gear 110 has not been completed (NO in S240), fluctuation suppression control unit 306 ends this process.

As described above, in the present embodiment, when the rotation mode is selected in response to the request to start engine 100, sudden fluctuation of speed Ne of engine 100 can be suppressed by controlling at least any one of engine 100, and alternator 132 and air-conditioner compressor 134, such that fluctuation of the load of engine 100 is suppressed before the time point when actuator 232 is actuated. Therefore, failure in achieving synchronization between speed Nm of motor 220 and speed Ne of engine 100 due to fluctuation of speed Ne of engine 100 while motor 220 is being driven and the rotation mode has been selected can be avoided. Namely, when actuator 232 is actuated after motor 220 is driven, speed Ne of engine 100 can accurately be predicted. Consequently, the timing to start driving motor 220 for synchronizing speed Ne of engine 100 and speed Nm of motor 220 with each other can accurately be set. Therefore, an engine starting device and an engine starting method for suppressing deterioration in engine starting capability can be provided.

In addition, in a case where suppression of fluctuation of the load is to be canceled when engagement between ring gear 110 and pinion gear 260 has been completed, the equipment causing the load of engine 100 to fluctuate can be actuated or actuation thereof can be stopped. Thus, a state of the vehicle can be controlled to a desired state.

Moreover, in a case where a state of actuation of the equipment causing the load of engine 100 to fluctuate (air-conditioner compressor 134 or alternator 132) is to be held during a period from the first time point after the request to start engine 100 was made to the second time point when actuator 232 is actuated, fluctuation of the load of engine 100 can be suppressed until actuator 232 is actuated, and thus deterioration in starting capability can be suppressed.

Further, in a case where a state of actuation of engine 100 is to be held during a period from the first time point after the request to start engine 100 was made to the second time point when actuator 232 is actuated, fluctuation of the load of engine 100 can be suppressed until actuator 232 is actuated, and thus deterioration in starting capability can be suppressed.

Furthermore, in a case where engine 100 or the equipment causing the load of engine 100 to fluctuate is controlled such that fluctuation of the load of engine 100 is prohibited during a period from the first time point after the request to start engine 100 was made to the second time point when actuator 232 is actuated, fluctuation of the load of engine 100 can be suppressed until actuator 232 is actuated, and thus deterioration in starting capability can be suppressed.

Still further, in a case where actuation of the equipment causing the load of engine 100 to fluctuate is prohibited during a period from the first time point after the request to start engine 100 was made to the second time point when actuator 232 is actuated, fluctuation of the load of engine 100 can be suppressed until actuator 232 is actuated, and thus deterioration in starting capability can be suppressed.

Then, in a case where variation in a control value for engine 100 is prohibited during a period from the first time point after the request to start engine 100 was made to the second time point when actuator 232 is actuated, fluctuation of the load of engine 100 can be suppressed until actuator 232 is actuated, and thus deterioration in starting capability can be suppressed.

In the present embodiment, ECU 300 controls actuator 232 and motor 220 so as to start engine 100, with any one mode of the first mode and the second mode being selected based on a speed of engine 100. Thus, an appropriate mode in accordance with the speed of engine 100 is selected. Therefore, when the second mode has been selected, engine 100 can more reliably be started.

It should be understood that the embodiments disclosed herein are illustrative and non-restrictive in every respect. The scope of the present invention is defined by the terms of the claims, rather than the description above, and is intended to include any modifications within the scope and meaning equivalent to the terms of the claims.

REFERENCE SIGNS LIST

10 vehicle; 100 engine; 110 ring gear; 111 crankshaft; 115 rotation speed sensor; 120 battery; 125 voltage sensor; 127

DC/DC converter; 130 voltage sensor; 132 alternator; 134 air-conditioner compressor; 136, 138, 168 pulley; 140 accelerator pedal; 142 electromagnetic clutch; 150 brake pedal; 160 throttle motor; 162 throttle position sensor; 164 throttle valve; 166 intake passage; 170 belt; 172 valve drive actuator; 200 starter; 210 plunger; 220 motor; 230 solenoid; 232 actuator; 240 coupling portion; 245 fulcrum; 250 output member; 260 pinion gear; 300 ECU; 302 determination unit; 304 starter control unit; and 306 fluctuation suppression control unit.

The invention claimed is:

1. An engine starting device, comprising:

a starter for start of an engine;

equipment coupled to a crankshaft of said engine and causing load of said engine to fluctuate; and a control device for said starter, said starter including a second gear that can be engaged with a first gear coupled to said crankshaft of said engine, an actuator for moving said second gear to a position of engagement with said first gear in a driven state, and a motor for rotating said second gear, said control device being capable of individually drive each of said actuator and said motor, said control device having a rotation mode in which said motor is driven prior to drive of said actuator, and said control device suppressing fluctuation of the load of said engine and said equipment before said actuator is driven, while said rotation mode is being executed.

2. The engine starting device according to claim 1, wherein said control device cancels suppression of fluctuation of said load when engagement between said first gear and said second gear is completed.

3. The engine starting device according to claim 1, wherein said equipment includes at least any one of an air-conditioner compressor and an alternator, and said control device holds a state of actuation of said equipment during a period from a first time point after said start is requested to a second time point when said actuator is actuated.

4. The engine starting device according to claim 1, wherein said control device holds a state of actuation of said engine during a period from a first time point after said start is requested to a second time point when said actuator is actuated.

5. The engine starting device according to claim 1, wherein said control device controls any one of said engine and said equipment so that fluctuation of the load of said engine is prohibited during a period from a first time point after said start is requested to a second time point when said actuator is actuated.

6. The engine starting device according to claim 5, wherein said equipment includes at least any one of an air-conditioner compressor and an alternator, and said control device prohibits actuation of said equipment during the period from the first time point after said start is requested to the second time point when said actuator is actuated.

7. The engine starting device according to claim 5, wherein said control device prohibits variation in a control value for said engine during the period from the first time point after said start is requested to the second time point when said actuator is actuated.

8. The engine starting device according to claim 1, wherein said control device controls said actuator and said motor such that said engine starts, with any one of a plurality of control modes being selected based on a rotation speed of said engine, and said plurality of control modes include a first control mode for actuating said actuator such that said second gear moves toward said first gear after said rotation mode is executed and a second control mode for actuating said motor after actuation of said actuator is started.

9. An engine starting method, an engine being provided with a starter for starting said engine, equipment coupled to a crankshaft of said engine and causing load of said engine to fluctuate, and a control device for a starter, said starter including a second gear that can be engaged with a first gear coupled to said crankshaft of said engine, an actuator for moving said second gear to a position of engagement with said first gear in a driven state, and a motor for rotating said second gear, each of said actuator and said motor being able to individually be driven, comprising the steps of:

driving said actuator and said motor in a rotation mode in which said motor is driven prior to drive of said actuator; and suppressing fluctuation of the load of said engine and said equipment before said actuator is driven, while said rotation mode is being executed.

* * * * *